US010611014B2

(12) United States Patent
Lazarov

(10) Patent No.: US 10,611,014 B2
(45) Date of Patent: Apr. 7, 2020

(54) TOOL HANDLE EXTENDERS

(71) Applicant: Ross Lazarov, Prior Lake, MN (US)

(72) Inventor: Ross Lazarov, Prior Lake, MN (US)

( * ) Notice: Subject to any disclaimer, the term of this patent is extended or adjusted under 35 U.S.C. 154(b) by 179 days.

(21) Appl. No.: 15/845,366

(22) Filed: Dec. 18, 2017

(65) Prior Publication Data

US 2019/0184541 A1 Jun. 20, 2019

(51) Int. Cl.
*B25G 1/04* (2006.01)
*B25G 3/00* (2006.01)

(52) U.S. Cl.
CPC ..... *B25G 1/043* (2013.01); *B25G 3/00* (2013.01)

(58) Field of Classification Search
CPC ..... B25G 1/043; B25G 3/00
USPC ..... 81/177.2, 184, 176.1
See application file for complete search history.

(56) References Cited

U.S. PATENT DOCUMENTS 1,689,639 A * 10/1928 Neff ..... B25B 13/08 81/177.2
3,113,479 A * 12/1963 Swingle ..... B25B 23/16 81/177.2
3,769,863 A * 11/1973 Griffin ..... B25G 1/043 81/177.2
3,850,056 A * 11/1974 Allen ..... B25B 15/008 81/438
4,581,958 A 4/1986 Shull
4,596,167 A * 6/1986 White, Jr. ..... B25G 1/043 81/177.2
4,811,638 A * 3/1989 Kertzscher ..... B25B 13/08 81/125.1
5,109,737 A 5/1992 Raber
5,911,798 A 6/1999 Arnold
6,216,566 B1 4/2001 Zurbuchen
6,308,596 B1 10/2001 Williams
6,405,619 B1 6/2002 Lamond et al.
6,532,846 B2 3/2003 Lin
6,550,358 B1 * 4/2003 Martin ..... B25B 13/06 81/177.2
6,626,069 B1 * 9/2003 Cooper ..... B25G 1/043 81/177.2
6,671,913 B2 1/2004 Wozniak
6,805,029 B1 10/2004 Foster et al.
6,845,692 B2 * 1/2005 Cooper ..... B25G 1/043 81/177.2
6,886,430 B1 5/2005 Tremblay et al.
7,182,000 B1 2/2007 Dicksen
7,322,264 B2 1/2008 Hu
8,424,424 B1 4/2013 Kravitch
8,746,112 B2 * 6/2014 Perry ..... B25B 13/48 81/176.1
8,931,376 B2 1/2015 Humphrey
9,440,338 B2 9/2016 Crawford
9,649,760 B2 5/2017 Klimsza
9,669,537 B2 6/2017 Hartman
2002/0157505 A1 10/2002 Wang
(Continued)

FOREIGN PATENT DOCUMENTS

GB 2356166 B 12/2003

*Primary Examiner* — David B. Thomas
(74) *Attorney, Agent, or Firm* — Haugen Law Firm PLLP

(57) ABSTRACT

An extension for a tool handle is described that may be used to provide additional torque when turning or unloosening an object. The device accommodates several types of ratchets, wrenches, or other hand tool handles and may be used alone or in combination with other torque enhancing tools.

18 Claims, 8 Drawing Sheets

(56) References Cited

U.S. PATENT DOCUMENTS

| | | | | |
|---|---|---|---|---|
| 2003/0167885 | A1 | 9/2003 | Coggins et al. | |
| 2006/0070499 | A1 | 4/2006 | Brooks | |
| 2007/0062343 | A1 | 3/2007 | Dodson, Jr. | |
| 2007/0157772 | A1 | 7/2007 | Parker | |
| 2010/0107828 | A1 | 5/2010 | Huerta | |
| 2011/0030516 | A1 | 2/2011 | Hodges, Jr. | |
| 2013/0098211 | A1* | 4/2013 | Sampson, Sr. ..... | B25G 1/005 81/177.2 |
| 2014/0102263 | A1 | 4/2014 | Reichlin | |
| 2014/0260829 | A1 | 9/2014 | Alfinito | |
| 2015/0251305 | A1 | 9/2015 | Mulligan | |
| 2015/0346327 | A1 | 12/2015 | Hensley | |
| 2016/0318172 | A1 | 11/2016 | Wright | |

* cited by examiner

TOOL HANDLE EXTENDERS

CROSS-REFERENCE TO RELATED APPLICATIONS

Not Applicable

FEDERAL SPONSORSHIP

Not Applicable

JOINT RESEARCH AGREEMENT

Not Applicable

TECHNICAL FIELD

This invention pertains generally to hand tools used to tighten and loosen nuts, bolts, or other objects attached to an adjoining body. More particularly, the invention pertains to an extension for a tool handle that may be used to provide additional torque when turning or unloosening an object. The tool handle extension of the present invention accommodates several variations on different types of drive socket ratchets, wrenches, or other hand tool handles and may be used alone or in combination with other torque enhancing tools.

BACKGROUND

Over the years various tools have been devised to increase the amount of torque exerted on an object. By way of example, various line wrenches, box wrenches, ratchet drives, adjustable wrenches, pipe wrenches, and locking hand tools are all utilized in particular varying situations where applying a torque to an object is desired. Typically, these hand tools include a specialized head connected to one or more handles. The handle has a length that limits the amount of torque that may be applied with the tool. From time to time it is desirable to be able to increase the amount of applied torque without changing out the tool having a different handle length.

Various adapters have been devised to couple to the hand tool that, in combination, provide the ability to exert an increased torque applied with the tool. Often times the size and shape of these adapters limits the ability to utilize the adapter with a wide variety of hand tools. A single tool handle extension capable of coupling to multiple function hand tools is expected to reduce cost and increase efficiency.

SUMMARY

Embodiments according to aspects of the invention provide a multi-purpose tool handle extension that couples to a variety of multiple function hand tools. The tool handle extension adapts to various sized and shaped handles for ratchets, wrenches, or other hand tool handles and may be used alone or in combination with other torque enhancing tools.

In accordance with aspects of the invention, an embodiment of the invention includes a hand tool handle extension having an elongated shaft, wherein a central bore or recess is formed in one end of the shaft and a hand grip is formed on an opposing end of the shaft. The hand tool extension further includes a slot extending into the elongated shaft from an outer surface of the shaft and intersects the bore or recess extending into the shaft. The slot has a length that is greater than a width of the slot and the recess is sized and shaped to receive a tool handle. The recess is particularly well suited for receiving the handle of a drive socket ratchet wrench. The slot is preferably sized to receive and engage with the open end of a box wrench.

Additionally, the hand tool handle extension may further include square apertures extending through a width of the elongate shaft proximate the hand grip. The elongate shaft may be formed from a cylindrical bar and the hand grip may include two parallel opposing flat sections with a width between the flat sections that is less than a diameter of the cylindrical bar. In accordance with certain aspects of the invention the recess may have various shaped cross sections including a round cross section, a square cross section, an elliptical cross section or other shape suitable to conform to a handle of a hand tool. By way of example and without limitation intended the recess may have a round cross section having a diameter ranging between 0.5 to 2 inches. The slot has one end that tapers to a point with a bevel formed on an upper edge of the tapered point. The beveled point may center the handle of the wrench within the slot and further provide stability to the wrench held in place within the slot.

In further accordance with aspects of the invention the hand tool handle extension apparatus of the present invention may include an elongated shaft having first and second opposing ends wherein the first end of the shaft has a recess extending into the shaft from the first end of the shaft. The recess is sized and shaped to receive a tool handle of a drive socket ratchet wrench or other suitable wrench. A slot extends into the elongated shaft from an outer surface of the shaft, wherein the slot has a length that is greater than a width of the slot and wherein the slot intersects the recess extending into the shaft. The slot is preferably sized and shaped to receive the handle of a box wrench or line wrench. A hand grip is formed in the second end of the shaft and includes at one square aperture extending through a width of the elongate shaft proximate the hand grip. The square aperture is well suited to receive the head of a drive socket ratchet wrench. Additionally, the hand tool extension apparatus may include two parallel opposing flat sections in the hand grip with a width between the flat sections less than a diameter of the bar.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

Figure 1:
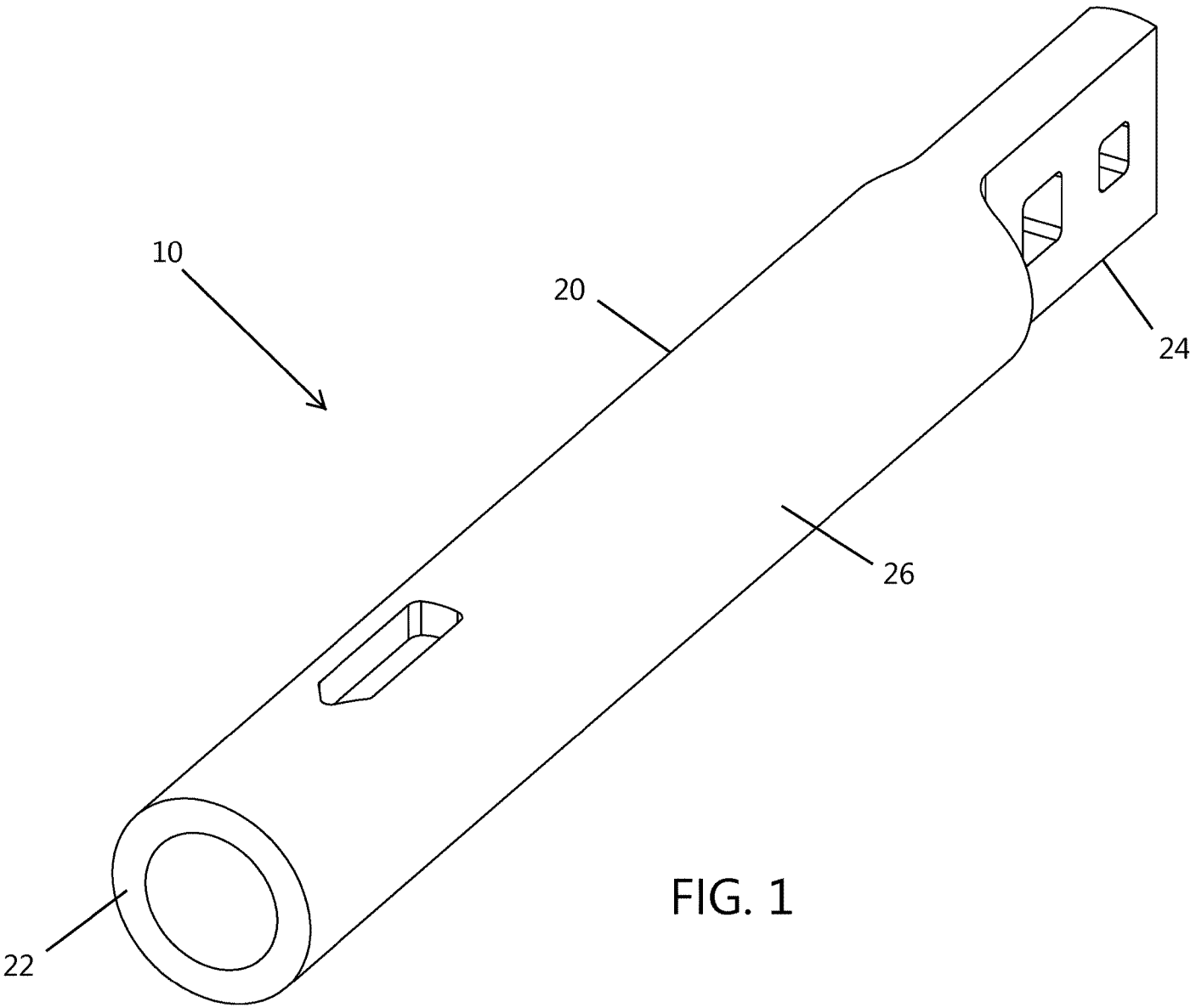
FIG. 1 is a top front right perspective view of a tool handle extender in accordance with an embodiment of the invention.
Figure 2:
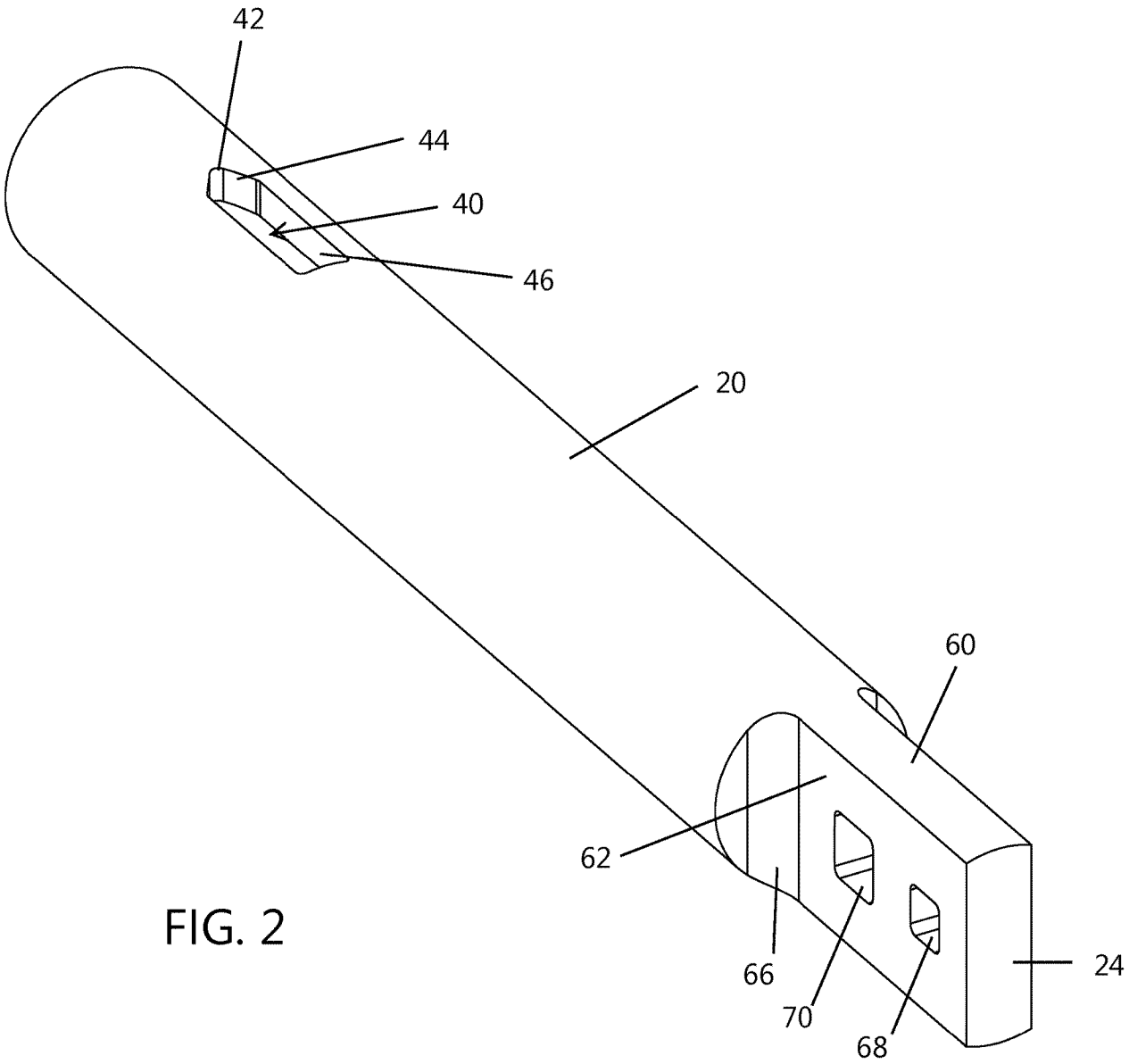
FIG. 2 is a top back right perspective view of the tool handle extender of the type shown in FIG. 1.
Figure 3:
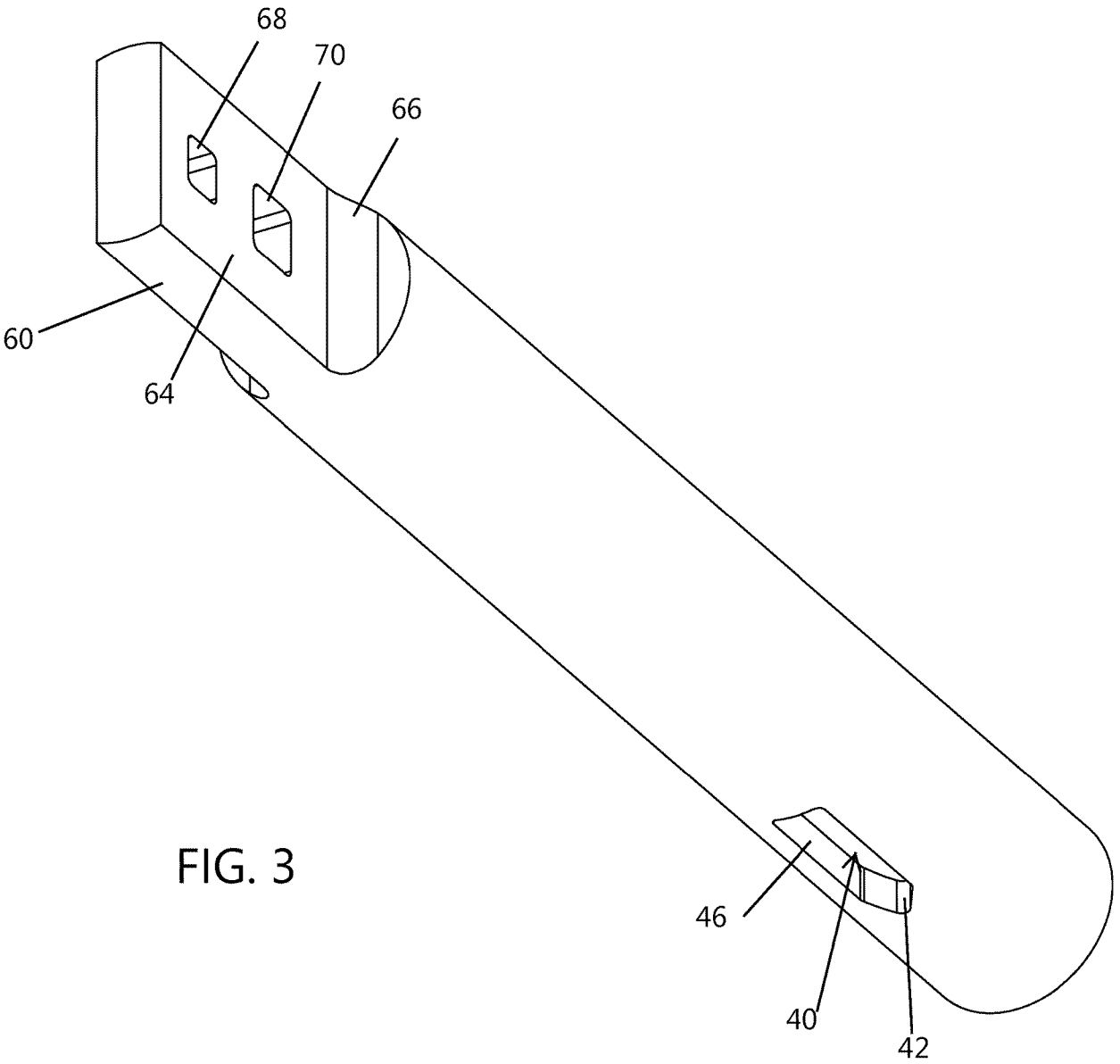
FIG. 3 is a bottom back left perspective view of the tool handle extender of the type shown in FIG. 1.
Figure 4:
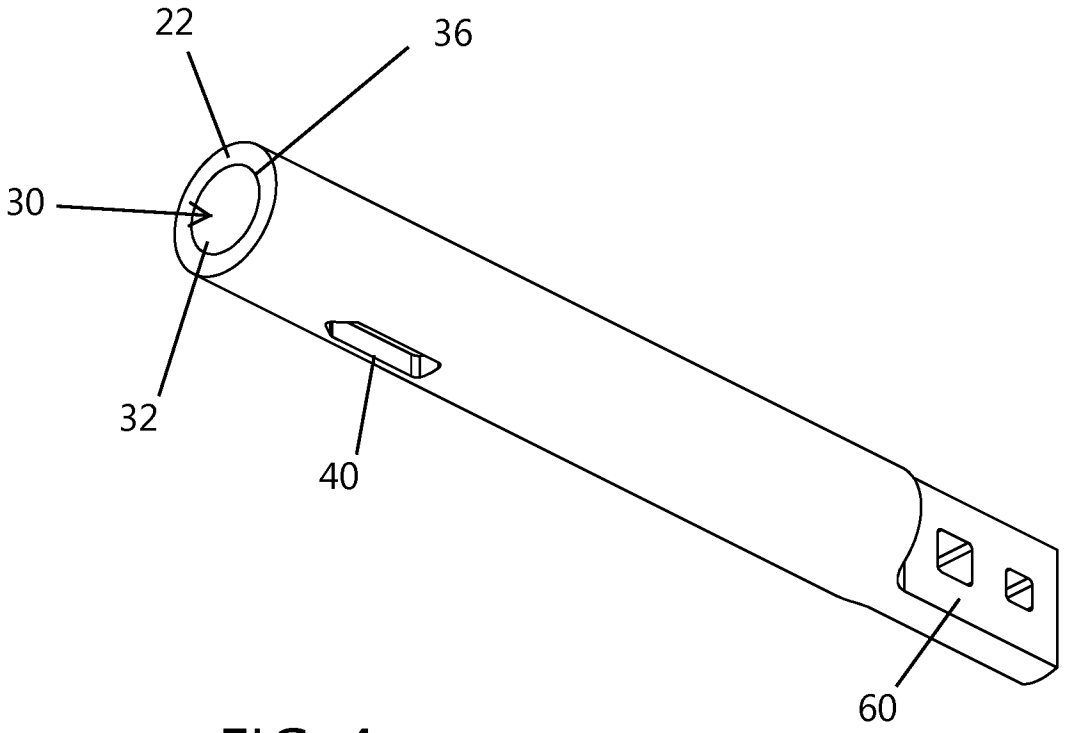
FIG. 4 is a bottom front right perspective view of the tool handle extender of the type shown in FIG. 1.

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

A hand tool extender 10 of the present invention is particularly well suited for extending the handle of a drive ratchet 14 or box wrench 16. The extender 10 generally includes an elongated body or shaft 20 that has a tool handle receiving recess 30 formed in a first end 22 of the shaft 20 and a handle 60 formed in a second opposed end 24 of the shaft 20. A slot 40 extends into the shaft 20 and intersects the slot 40.

With reference to the figures and in particular with reference to FIGS. 1-4, a hand tool extender 10 is generally illustrated having an elongated body or shaft 20. The shaft 20 includes first and second opposed ends 22 and 24 separated by an exterior surface 26 of the shaft. Preferably, the elongate shaft 20 may be 12, 13 or 24 inches in length. The first end 22 of the shaft 20 includes a recess or bore 20 extending into the shaft 20 along a longitudinal axis of the shaft. The recess or bore 20 has an internal wall 32 that defines the hollow interior of the recess. Those skilled in the art will appreciate that the recess may have a variety shapes and contours. Although a cylindrical bore 34 having circular cross section is illustrated, it will be appreciated that an ellipse may be utilized to better engage the handle of a tool having an approximately rectangular cross section. The round or circular cross section has a diameter ranging between 0.5 to 2 inches. Of course, the diameter of the recess may be increased or decreased however this range of diameters accommodates most tool handles.

Elongated slot 40 extends from the exterior surface 26 of the elongated shaft 20 into the shaft. The slot is sized to receive an open end of a wrench and the slot is positioned along the shaft so that the slot intersects the recess 30. The end of the slot that is closer to the first end 22 of the shaft 20 forms a point 42 and the pointed end wall includes a bevel 44. This shape is preferred to create more surface area that contacts and engages with the open end of the wrench. The slot sidewalls 46 are spaced apart a sufficient distance to accommodate the thickness of various sized wrenches.

Handle 60 includes first and second spaced apart flat surfaces 62 and 64. The width between the flat surfaces is less than the overall width or diameter of the elongated shaft 20. The length of the handle section is preferably between 2 and 3 inches. Square apertures 68 and 70 extend through the handle 60 between the flat surfaces 62 and 64. The square apertures are sized to accept a ⅜" and ½" drive socket ratchet wrenches. The flat portion of the drive ratchet head rests against the flat surface of the handle which provides stability between the extender 10 and drive socket ratchet 14. Contoured corners 66 provide strength to the intersection between handle 60 and elongated bar or shaft 20.

Figure 5:
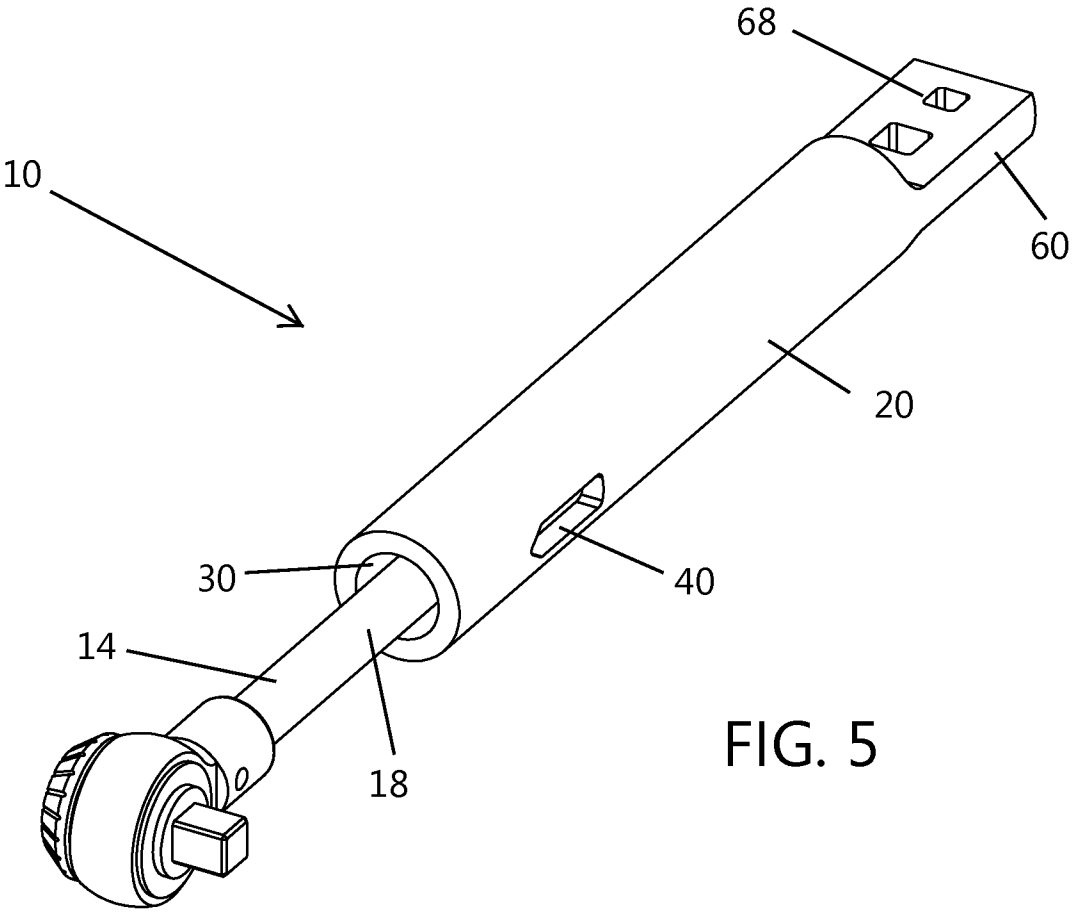
FIG. 5 is a perspective view of the tool handle extender in accordance with an embodiment of the invention in use with a drive socket ratchet wrench.
Figure 6:
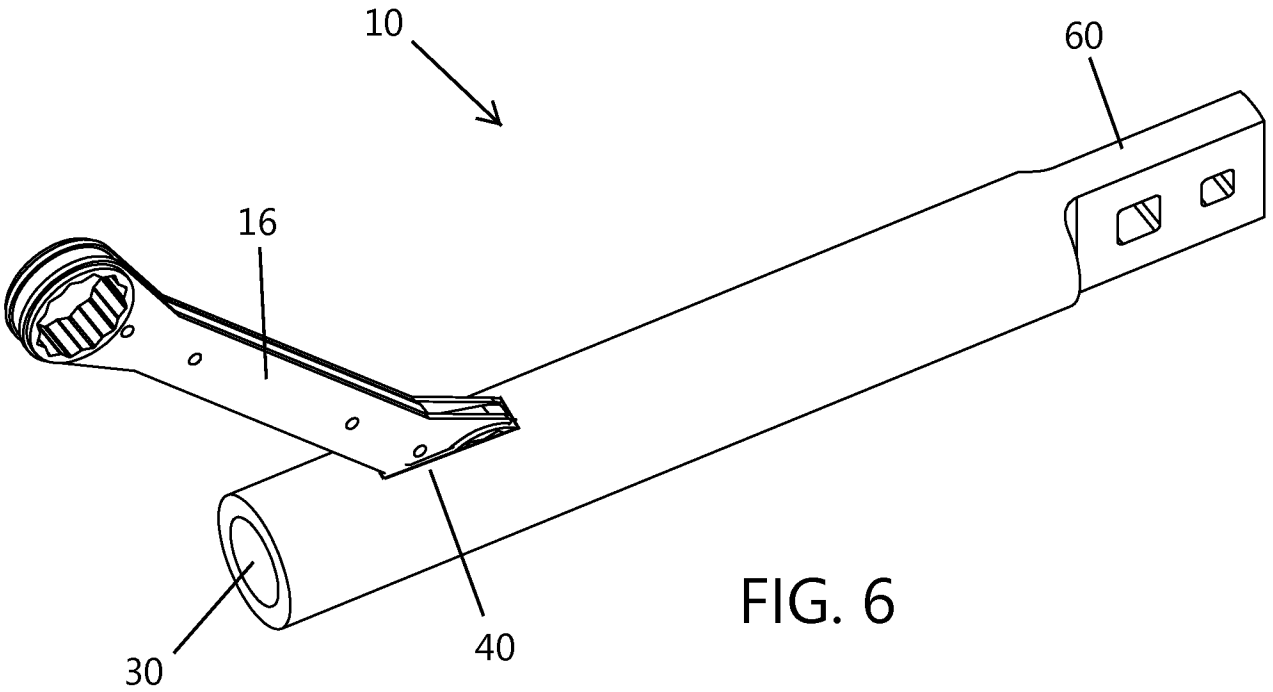
FIG. 6 is a perspective view of the tool handle extender in accordance with an embodiment of the invention in use with a ratchet wrench.
Figure 7:
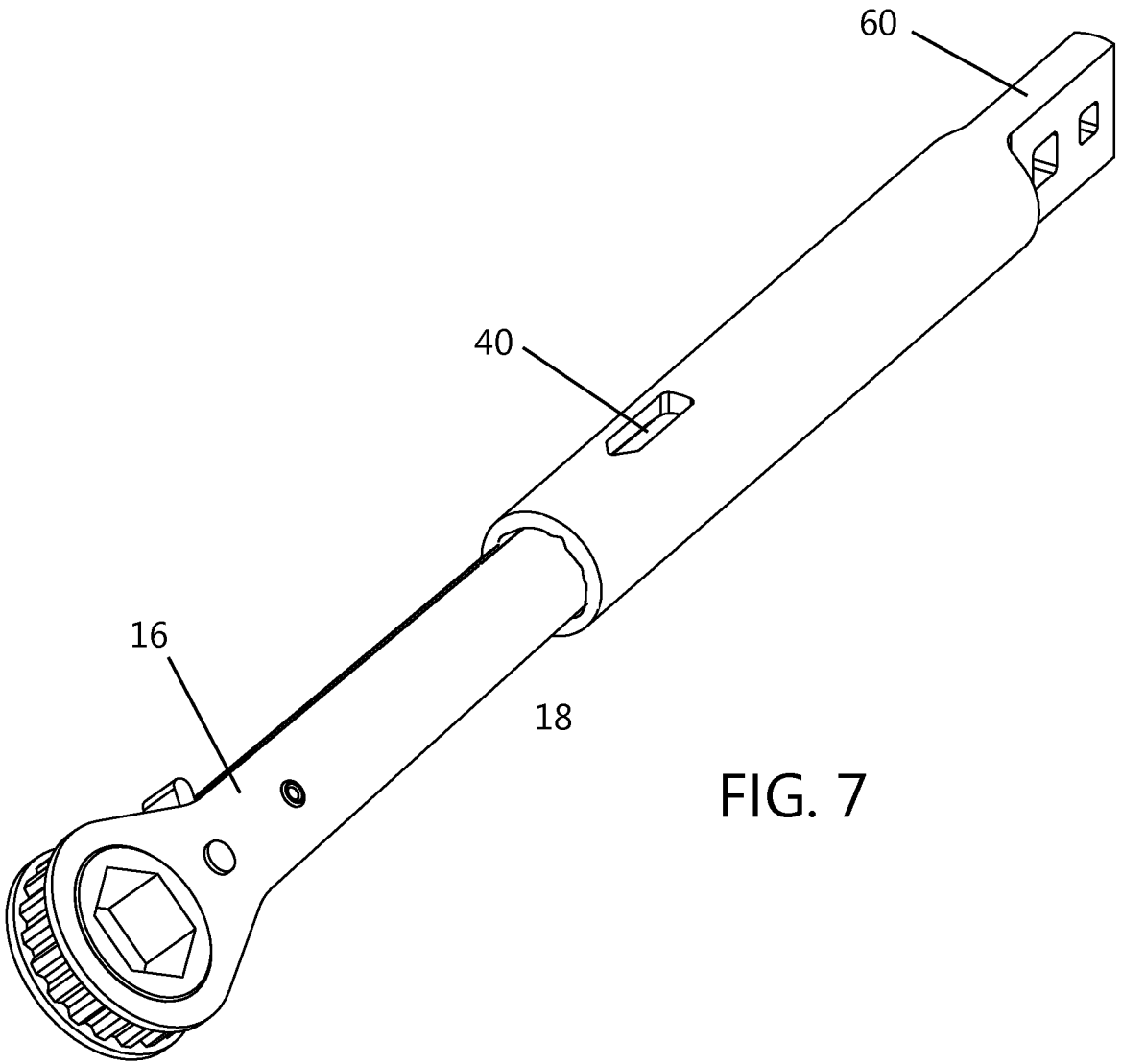
FIG. 7 is a perspective view of the tool handle extender in accordance with an embodiment of the invention in use with a ratchet wrench.
Figure 8:
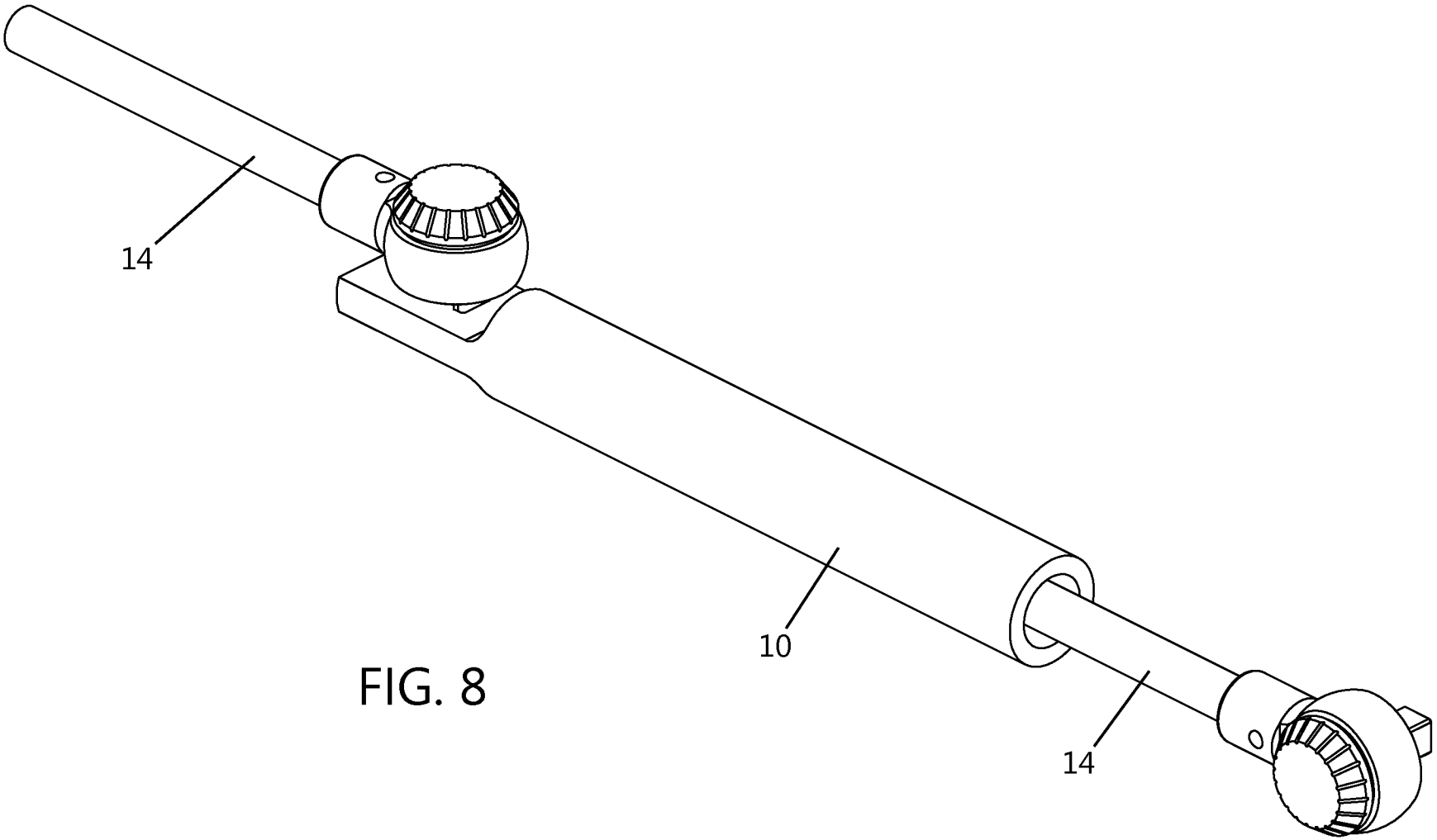
FIG. 8 is a perspective view of the tool handle extender in accordance with an embodiment of the invention in use with multiple drive socket ratchet wrenches.

Embodiments of the invention illustrated in FIGS. 5-8, demonstrate the versatility of the hand tool extender 10 of the present invention. FIG. 5 shows a tool handle extender 10 in accordance with an embodiment of the invention in use with a drive socket ratchet wrench 14. Handle 18 of the drive socket ratchet extends into the bore 30 of the elongated shaft 20. FIG. 6 shows a tool handle extender 10 in accordance with an embodiment of the invention in use with a ratchet wrench 16. An open end of the wrench 18 is inserted and engaged within slot 40. Alternatively, as illustrated in FIG. 7, an end of the wrench 18 may be inserted into the bore 30 of the elongate shaft. In situations where additional torque is desired beyond what can be provided with a drive socket ratchet, as illustrated in FIG. 8, additional drives 14 and extenders 10 may be combined together to create a lever arm of desired length. Other tool handles, including for example without limitation a channel lock, adjustable width wrench or allen wrench, may be engaged within the recess 30 to provide additional leverage for the tool.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. A hand tool handle extension apparatus, the apparatus comprising:

an elongated shaft having first and second opposing ends;

the first end of the shaft has a recess extending into the shaft from the first end of the shaft, wherein the recess is sized and shaped to receive a tool handle;

a slot extending into the elongated shaft from an outer surface of the shaft, wherein the slot has a length that is greater than a width of the slot and wherein the slot intersects the recess extending into the shaft; and wherein the slot has one end that tapers to a point with a bevel formed on an upper edge of the tapered point; and a hand grip formed in the second end of the shaft.

2. The apparatus as recited in claim 1 further including square apertures extending through a width of the elongate shaft proximate the hand grip.

3. The apparatus as recited in claim 1, wherein the elongate shaft is formed from a cylindrical bar.

4. The apparatus as recited in claim 3, wherein the hand grip includes two parallel opposing flat sections with a width between the flat sections less than a diameter of the cylindrical bar.

5. The apparatus as recited in claim 1, wherein the recess has a round cross section.

6. The apparatus as recited in claim 5, wherein the round cross section has a diameter ranging between 0.5 to 2 inches.

7. A hand tool handle extension apparatus, the apparatus comprising:

an elongated shaft having first and second opposing ends;

the first end of the shaft has a recess extending into the shaft from the first end of the shaft, wherein the recess is sized and shaped to receive a tool handle;

a slot extending into the elongated shaft from an outer surface of the shaft, wherein the slot has a length that is greater than a width of the slot and wherein the slot intersects the recess extending into the shaft;

a hand grip formed in the second end of the shaft; and square apertures extending through a width of the elongate shaft proximate the hand grip.

8. The apparatus as recited in claim 7, wherein the elongate shaft is formed from a cylindrical bar.

9. The apparatus as recited in claim 8, wherein the hand grip includes two parallel opposing flat sections with a width between the flat sections less than a diameter of the cylindrical bar.

10. The apparatus as recited in claim 7, wherein the recess has a round cross section.

11. The apparatus as recited in claim 10, wherein the round cross section has a diameter ranging between 0.5 to 2 inches.

12. The apparatus as recited in claim 7 wherein the slot has one end that tapers to a point with a bevel formed on an upper edge of the tapered point.

13. A hand tool handle extension apparatus, the apparatus comprising:

an elongated shaft having first and second opposing ends;

the first end of the shaft has a recess extending into the shaft from the first end of the shaft, wherein the recess is sized and shaped to receive a tool handle;

a slot extending into the elongated shaft from an outer surface of the shaft, wherein the slot has a length that is greater than a width of the slot and wherein the slot intersects the recess extending into the shaft, wherein the slot has one end that tapers to a point with a bevel formed on an upper edge of the tapered point;

a hand grip formed in the second end of the shaft; and square apertures extending through a width of the elongate shaft proximate the hand grip.

14. The apparatus as recited in claim 13, wherein the elongate shaft is formed from a cylindrical bar.

15. The apparatus as recited in claim 14, wherein the hand grip includes two parallel opposing flat sections with a width between the flat sections less than a diameter of the cylindrical bar.

16. The apparatus as recited in claim 13, wherein the recess has a round cross section.

17. The apparatus as recited in claim 16, wherein the round cross section has a diameter ranging between 0.5 to 2 inches.

18. The apparatus as recited in claim 13 wherein the slot has one end that tapers to a point with a bevel formed on an upper edge of the tapered point.

* * * * *